US007157672B2

(12) United States Patent
Gandy

(10) Patent No.: US 7,157,672 B2
(45) Date of Patent: Jan. 2, 2007

(54) METHOD OF MANUFACTURING STAINLESS STEEL PIPE FOR USE IN PIPING SYSTEMS

(75) Inventor: John Gandy, Conroe, TX (US)

(73) Assignee: Gandy Technologies Corporation, Conroe, TX (US)

( * ) Notice: Subject to any disclaimer, the term of this patent is extended or adjusted under 35 U.S.C. 154(b) by 168 days.

(21) Appl. No.: 10/699,765

(22) Filed: Nov. 3, 2003

(65) Prior Publication Data

US 2004/0234715 A1 Nov. 25, 2004

Related U.S. Application Data

(60) Provisional application No. 60/472,077, filed on May 20, 2003, provisional application No. 60/463,678, filed on Apr. 17, 2003.

(51) Int. Cl.
*B23K 13/02* (2006.01)
*B23K 101/06* (2006.01)
*B23K 103/04* (2006.01)

(52) U.S. Cl. ..... 219/612; 219/617; 219/649; 228/151; 228/173.7; 29/407.01; 138/171

(58) Field of Classification Search ..... 428/685, 428/586, 934; 138/156, 171; 148/519, 520; 219/600, 603, 607, 612, 617
See application file for complete search history.

(56) References Cited

U.S. PATENT DOCUMENTS

| | | | | |
|---|---|---|---|---|
| 2,673,276 A | | 3/1954 | Allardt | 219/6 |
| 3,046,167 A | | 7/1962 | Waxweiler | 148/135 |
| 3,242,299 A | | 3/1966 | Laughlin | 219/8.5 |
| 3,486,219 A | | 12/1969 | Davies et al. | 29/480 |
| 3,716,908 A | | 2/1973 | Rowell | 29/477.7 |
| 4,160,543 A | | 7/1979 | Dill et al. | 266/252 |
| 4,523,072 A | | 6/1985 | Nakate et al. | 219/67 |
| 4,644,272 A | | 2/1987 | Janos | 324/240 |
| 5,820,703 A | * | 10/1998 | Suzuki et al. | 219/612 |
| 6,379,821 B1 | * | 4/2002 | Kushida et al. | 428/685 |
| 2003/0057695 A1 | * | 3/2003 | Toyooka et al. | 280/781 |
| 2003/0188813 A1 | * | 10/2003 | Hirasawa et al. | 148/609 |
| 2004/0003876 A1 | * | 1/2004 | Ota et al. | 148/602 |

* cited by examiner

*Primary Examiner*—John J. Zimmerman
(74) *Attorney, Agent, or Firm*—Charles D. Gunter, Jr.

(57) ABSTRACT

A welded low carbon dual phase (ferrite plus martensite) and/or low carbon martensitic stainless steel PIPE having requisite yield strength and corrosion and/or erosion resistance is shown. Pipe can be manufactured up to a maximum outside diameter from finished plate or coil by utilizing a high speed-forming mill rather than using the traditional costly seamless pierced billet methods, or utilizing U-O-E or break press. An ERW technique is also used rather than utilizing the traditional laser, tungsten inert gas, gas metal arc, plasma arc, submerged arc or double submerged arc welding methods; or the parameters and procedures for ERW traditionally used to weld carbon steel pipe. Welded pipe dimensions and mechanical properties can be achieved which comply with the heat treatment process and the continuous roll forming mill's capability to produce the yield strengths and dimensional tolerances required to meet the service criteria of the pipe's intended application.

8 Claims, 3 Drawing Sheets

Chemical Balance For Dual Phase Microstructure $$K_m = Cr + 6\,Si + 8\,Ti + 4\,Mo + 2\,Al - 2\,Mn - 4\,Ni - 40\,(C+N) - 20\,P - 5\,Cu$$

METHOD OF MANUFACTURING STAINLESS STEEL PIPE FOR USE IN PIPING SYSTEMS

CROSS REFERENCE TO RELATED APPLICATION

This application claims priority from provisional application Ser. No. 60/472,077, filed May 20, 2003, and entitled "Method of Manufacturing Pipe for Transportation Piping Systems," by John Gandy and from provisional application Ser. No. 60/463,678, filed Apr. 17, 2003, entitled "Method of Manufacturing Corrosion and/or Erosion Resistant Welded Pipe Using Electric Resistance Welding", by John Gandy.

BACKGROUND OF THE INVENTION

Field of the Invention

The present invention relates generally to pipe metallurgy and manufacturing processes and, more specifically, to a stainless steel with a chemistry that is compatible with Electric Resistant Welding (ERW) for the manufacture of corrosion and/or erosion resistant stainless steel (PIPE) for use in down-hole applications for oil and gas production, line pipe for transportation of liquids, gas and slurry, and process pipe for mining, refining, power generating and petrochemical plant piping systems.

The compatible stainless steel(s) of this invention is a low carbon (0.080% maximum content by weight) dual phase (ferrite plus martensite) stainless steel containing 10.5 to 14% chromium content by weight and/or a low carbon (0.080% maximum content by weight) martensitic stainless steel containing 10.5 to 14% chromium content by weight. The Laser weld process without filler metal and the ERW process conducted without filler metal as described herein eliminate filler wire melted weld metal and minimize the weld's Heat Affected Zone (HAZ) resulting in superior weld ductility compared to a like chemistry welded by Tungsten Inert Gas (TIG), Gas Metal Arc Weld (MIG), Plasma Arc (PLASMA), Submerged Arc Welding (SAW), or Double Submerged Arc Welding (DSAW) methods with filler metal. Also the ERW manufacturing method is more cost effective than production of seamless pipe of like chemistry, LASER welded pipe of like chemistry without filler metal and welded pipe of like chemistry with filler metal. This method also includes an optional post continuous induction or gas fired heat treatment of the martensitic weld HAZ.

Description of the Prior Art

Down-hole pipe, line pipe, and process pipe (PIPE) is used for production of oil and gas and liquids, gas and/or slurry transportation systems in the oil and gas, petrochemical, refining, power generating and mining industries. PIPE may be installed in both vertical and horizontal planes with the plane being dependent on the application in which the PIPE is to be utilized. In addition, the PIPE may be subjected to corrosive environments containing small to substantial quantities of carbon dioxide and other corrosive elements or compounds. Also erosive conditions may exist in liquids, gas or slurry containing abrasive particles. In recent years, work has been done to develop PIPE that exhibits improved corrosion resistance to failure from $CO_2$ stress corrosion cracking and corrosion pitting; and improved erosion resistance from abrasive materials in liquids, gas and slurries being transported by the PIPE.

PIPE subjected to these conditions may fail in a relatively short time due to such factors as stress corrosion cracking, intergranular corrosion and general corrosion metal loss.

Wall loss may also be caused by erosion. The failure characteristic of steel PIPE may be influenced by many factors, including the chemistry of the steel, steel microstructure, the mechanical processing of the steel and the nature of the heat treatment which may be provided.

In regard to corrosion, one commonly used method of preventing corrosion in PIPE at the present time is to coat the inside diameter surfaces with a thin layer of an anti-corrosive material. The primary purpose of such coating is to extend the operational life of the PIPE by providing a physical barrier between the corrosive agent and the base metal. Typical coating materials include paints, phenolic compounds, epoxies, urethanes, and nylon compounds.

Another way to prevent corrosion and/or erosion is to make the PIPE out of a "Corrosion/Erosion Resistant Alloy" (CERA). Such CERA materials include, for example, the five alloys in the stainless family defined as martensitic, dual phase (martensite and ferrite), ferritic, austenitic, and duplex (austenite plus ferrite). Dual phase (ferrite plus martensite) is a stainless steel whose microstructure at room temperature consists of ferrite and martensite due to a special chemical balance. Martensitic stainless steel is one that has a martensite microstructure. Duplex (austenitic/ferrite) is a stainless steel whose microstructure at room temperature consists primarily of a near equal volume percent of austenite and ferrite. The term ferritic describes chromium stainless steels with a ferrite microstructure. Chromium stainless steels are divided into two classifications, hardenable and non-hardenable. When rapidly cooled from elevated temperatures the non-hardenable grades (ferritic) have a ferritic microstructure. The hardenable grades (martensitic) will exhibit a martensitic microstructure when rapidly cooled to room temperature. Austenitic denotes low carbon, iron-chromium-nickel stainless alloys containing more than 16% chromium, with sufficient nickel to stabilize austenitic microstructure at room temperature. These alloys cannot be hardened by heat treatment, but can be hardened by cold working. Such grades are normally non-magnetic, but can be slightly magnetic depending upon composition and amount of cold working. Classification or definition of the individual stainless steel family members is determined by the steel's chemical balance and resulting crystal structures as follows:

1) Austenite: a solid solution of one or more elements in face-centered cubic crystal structure.
2) Ferrite: a solid solution of one or more elements in body-centered cubic crystal structure.
3) Martensite: a solid solution of one or more elements in a tetragonal crystal structure. The martensitic microstructure is characterized by an acicular, or needle-like, pattern microstructure. Commercial examples of such classes of materials are martensitic seamless PIPE with 13% chromium content by weight used for down-hole oil and gas applications, austenitic pipe with 22% chromium and 42% nickel content by weight used for down-hole production of oil and gas, duplex stainless steel with 22% chromium and 5% nickel content by weight used for down-hole production of oil and gas and austenitic stainless steel 316L pipe used for line pipe to transport liquid and gas and for in-plant process pipe that are sold by the John Gandy Corporation of Conroe, Tex. The key alloy additions for Type 316L corrosion resistance is chromium with molybdenum added for superior resistance to pitting corrosion. Type 316L stainless steel exhibit different degrees of corrosion resistance both with or without a passive film depending on the corrosion environment. A passive film will not exist under the condition of erosion.

The above noted problems and other similar corrosion and/or erosion conditions make it desirable to provide a stainless steel PIPE. However, the introduction of stainless steel poses additional challenges for the manufacture of PIPE of the type under consideration. There are two well known commercial processes in use for manufacturing prior art steel PIPE such as those used in down-hole applications for oil and gas production, line pipe for transportation of liquids, gas and slurry, and process pipe for mining, refining, power generating and petrochemical plant piping systems. These processes produce either "seamless" steel pipe or they produce "welded" steel pipe. In general, a seamless steel pipe is produced by preparing a solid billet, forming a hollow shell by a method such as Mannesmann piercing, press piercing or hot extrusion, and rolling the thus-formed hollow shell by a rolling mill such as an elongator, plug mill or a mandrel mill and subjecting the rolled hollow shell to a sizing work performed with a sizer or a stretch reducer, whereby the final pipe product of a predetermined size is obtained.

In a typical prior art process, a seamless PIPE is manufactured, for example, from a billet of steel about 10 inches in diameter and 6 to 8 feet long. After heating to over 1000 degrees C., a hole is pierced through the center to form a very thick-walled tube. Hot rolling and cold drawing then progressively reduces the wall thickness and diameter of this tube until it is sized for the particular end purpose. Seamless is a costly method of manufacture; restricted both in size of outside diameter and in length.

Welded PIPE, on the other hand, is made from a flat strip referred to as plate or coil, which is formed into a PIPE and the two longitudinal edges of the plate or coil are welded to each other along the PIPE's length. There are seven typical and traditional welding methods utilized in the manufacture of welded PIPE. These methods are Laser, Tungsten Inert Gas (TIG), Gas Metal Arc Weld (MIG), Plasma Arc, Submerged Arc Welding (SAW), Double Submerged Arc Welding (DSAW) and Electric Resistance Welding (ERW). Additional care is necessary to avoid structural and cosmetic defects in the weld and the weld zone. Since such problems cannot arise from a seamless pipe, the seamless manufacturing process offers advantages in many situations. However, the cost incurred with the manufacture of seamless PIPE, and particularly the manufacturing restriction of certain larger sizes and longer lengths, together with the difficulties attendant upon the known processes of producing such PIPE, and the lack of uniformity with respect to successive PIPES has, to a large extent, driven the industry to the use of welded PIPE. Welded PIPE is the least costly method of manufacture and is not restricted in outside diameter and normally not restricted in length; and is equal in quality to seamless.

Another characteristic of welded PIPE versus seamless PIPE is that welded PIPE manufactured by TIG, MIG, Plasma Arc, SAW, or DSAW traditionally use filler metal. Laser and ERW welding processes do not use filler metal. Successful welding of typical dual phase (ferrite plus martensite), martensitic, ferritic, austenitic, and duplex (austenite and ferrite) stainless steels with 10.5 to 24% chromium content by weight, historically and traditionally has been restricted to TIG, MIG, Plasma Arc, SAW, and DSAW welding methods. To the applicant's knowledge the ERW method has not been practiced on dual phase (ferrite plus martensite), martensitic, ferritic, austenitic, and duplex (austenite and ferrite) stainless steels with 10.5 to 14% chromium content by weight for use in down-hole applications for oil and gas production, line pipe for transportation of liquids, gas and slurry, and process pipe for mining, refining, power generating and petrochemical plant piping systems. By the "ERW method" is meant a process for manufacturing a pipe from strip, sheet or bands by electric resistance heating and pressure, the strip being a part of the electric circuit. The electric current, which may be introduced into the strip through electrodes or by induction, generates the welding heat through the electrical resistance of the strip. Also to the applicant's knowledge the ERW method has not been practiced on low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel PIPE for use in down-hole applications for oil and gas production, line pipe for transportation of liquids, gas and slurry, process plant, power generating and/or refining piping systems.

The present invention has as one object to manufacture corrosion and/or erosion resistant stainless steel PIPE by the ERW welding method without a filler metal from low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel PIPE for use in down-hole applications for oil and gas production, line pipe for transportation of liquids, gas and slurry, process plant, power generating and/or refining piping systems.

Another object of the present invention is to manufacture corrosion and/or erosion resistant ERW welded PIPE without filler metal from low carbon (0.080% maximum content by weight) dual phase (ferrite plus martensite) with 10.5 to 14% chromium content by weight stainless steel and/or low carbon (0.080% maximum content by weight) martensitic stainless steel with 10.5 to 14% chromium content by weight for use in down-hole applications for oil and gas production, line pipe for transportation of liquids, gas and slurry, process plant, power generating and/or refining piping systems that is more commercially economical than stainless steel PIPE with 10.5 to 14% chromium content by weight traditionally welded by TIG, MIG, Plasma Arc, SAW and DSAW with filler metal for like piping systems which are more costly due to slow forming and welding speeds and the cost of filler metal when compared to the ERW process.

Another object of the present invention is to manufacture corrosion and/or erosion resistant ERW welded PIPE without filler metal from low carbon (0.080% maximum content by weight) dual phase (ferrite plus martensite) with 10.5 to 14% chromium content by weight stainless steel and/or low carbon (0.080% maximum content by weight) martensitic stainless steel with 10.5 to 14% chromium content by weight for use in down-hole applications for oil and gas production, line pipe for transportation of liquids, gas and slurry, process plant, power generating and/or refining piping systems that is equal in base metal mechanical properties but exhibits superior weld ductilities due to low heat input, resulting in a very narrow weld bond line and heat affected zone (HAZ) when compared with other stainless steel PIPE with 10.5 to 14% chromium traditionally welded by TIG, MIG, Plasma Arc, SAW and DSAW with filler metal for like piping systems.

Another object of the present invention is to manufacture corrosion and/or erosion resistant ERW welded PIPE without filler metal from low carbon (0.080% maximum content by weight) dual phase (ferrite plus martensite) with 10.5 to 14% chromium content by weight stainless steel and/or low carbon (0.080% maximum content by weight) martensitic stainless steel with 10.5 to 14% chromium content by weight for use in down-hole applications for oil and gas production, line pipe for transportation of liquids, gas and slurry, process plant, power generating and/or refining piping systems that is equal or superior in quality when compared to 10.5 to 14% percent chromium content stainless steel pipe traditionally welded by TIG, MIG, Plasma Arc, SAW or DSAW methods with filler metal that often incur the problem of producing low ductility welds with excessively large weld metal deposits and wide HAZ due to the high heat induced by the method. This problem is compounded by weld metal (melted filler wire) dilution by the base metal.

Another object of the present invention is to manufacture ERW corrosion and/or erosion resistant welded PIPE without a filler metal from low carbon (0.080% maximum content by weight) dual phase (ferrite plus martensite) with 10.5 to 14% chromium content by weight stainless steel and/or low carbon (0.080% maximum content by weight) martensitic stainless steel with 10.5 to 14% chromium by content by weight for use in down-hole applications for oil and gas production, line pipe for transportation of liquids, gas and slurry, process plant, power generating and/or refining piping systems that is more commercially economical than seamless stainless steel PIPE with 10.5 to 14% chromium content manufactured by the pierced billet method.

Another object of the present invention is to manufacture ERW corrosion and/or erosion resistant welded PIPE without a filler metal from low carbon (0.080% maximum content by weight) dual phase (ferrite plus martensite) with 10.5 to 14% chromium content by weight stainless steel and/or low carbon (0.080% maximum content by weight) martensitic stainless steel with 10.5 to 14% chromium content by weight for use in down-hole applications for oil and gas production, line pipe for transportation of liquids, gas and slurry, process plant, power generating and/or refining piping systems that is equal in mechanical properties to seamless stainless steel PIPE with 10.5 to 14% chromium content by weight manufactured by the pierced billet method.

Another object of the present invention is to manufacture ERW corrosion and/or erosion resistant welded PIPE without a filler metal from low carbon (0.080% maximum content by weight) dual phase (ferrite plus martensite) with 10.5 to 14% chromium content by weight stainless steel and/or low carbon (0.080% maximum content by weight) martensitic stainless steel with 10.5 to 14% chromium content by weight for use in down-hole applications for oil and gas production, line pipe for transportation of liquids, gas and slurry, process plant, power generating and/or refining piping systems that is equal in quality to seamless stainless steel PIPE with 10.5 to 14% chromium content manufactured by the pierced billet method.

Another object of the present invention is to manufacture PIPE without a filler metal for use in down-hole applications for oil and gas production, line pipe for transportation of liquids, gas and slurry, process plant, power generating and/or refining piping systems from low carbon (0.080% maximum content by weight) dual phase (ferrite plus martensite) with 10.5 to 14% chromium content by weight stainless steel and/or low carbon (0.080% maximum content by weight) martensitic stainless steel with 10.5 to 14% chromium content by weight by the ERW welding method that results in a very narrow bond line and HAZ in addition to a low carbon soft martensite in the HAZ producing a much more ductile weld than the weld of stainless steel with 10.5 to 14% chromium content by weight PIPE welded by TIG, MIG, Plasma Arc, SAW and DSAW methods.

SUMMARY OF THE INVENTION

The present invention describes low carbon (0.080% maximum content by weight) dual phase (ferrite plus martensite) stainless steel with 10.5 to 14% chromium content by weight and/or low carbon (0.080% maximum content by weight) martensitic stainless steel with 10.5 to 14% chromium content by weight that is compatible for manufacturing welded PIPE by the ERW welding method for use in down-hole applications for oil and gas production, line pipe for transportation of liquids, gas and slurry, and process pipe for mining, refining, power generating, and petrochemical plant piping systems. More particularly, the invention describes a process for manufacturing welded PIPE from low carbon (0.080% maximum content by weight) dual phase (ferrite plus martensite) stainless steel with 10.5 to 14% chromium content by weight and/or low carbon (0.080% maximum content by weight) martensitic stainless steel with 10.5 to 14% chromium content by weight by the ERW method without the use of filler metal. The ERW PIPE will have medium to high strength; toughness and excellent corrosion and erosion resistance in the weld HAZ, especially due to stress corrosion cracking, intergranular corrosion and abrasive wear, which is characterized by the specified chemical composition of the stainless steel grades utilized and specified thermal and mechanical treatment of the materials.

Welding process of the invention utilizes an ERW manufacturing method without a filler metal, rather than using the traditional LASER welding without filler metal; or by using the TIG, MIG, Plasma Arc, SAW, and DSAW welding methods with filler metal which build in excessive heat causing weld metal (melted filler wire) dilution and wide HAZ. The process of the invention also utilizes edge trimming to remove surplus width, remove and clean oxide buildup, and eliminate all edge cracks on the edges of the plate or coil prior to the plate or coil's entry into a high speed roll forming mill. While the plate or coil is in the roll forming mill, the formed PIPE is restrained vertically and horizontally with the longitudinal edges of the two sides pushed together at a pressure sufficient to hot upset and squeeze out the surplus pliable stainless steel that is created during the upset process (referred to as squeeze material). The ERW hot upset process assures all refractory chromium oxides are squeezed out. This promotes a sound bond line. Simultaneous with the PIPE traveling longitudinally at speeds of up to 100 feet per minute with the actual speed being dependent on the wall thickness of the PIPE and the electrical current frequency of the induction welder, the edges are bonded together at a high temperature formulated to match the wall thickness with the steel chemistry of the PIPE. The squeeze material is then removed flush with the pipe body by scarf blades from the inside and outside diameters of the PIPE. In part, the process involves an optional post weld automatic inline heat treatment by induction or gas fired heating of the weld and the adjacent weld zones and/or the full body of the PIPE immediately following the welding process.

The final step in the preferred method of the invention involves the ultrasonic or electromagnetic inspection of the weld line to insure that a complete weld has been accomplished.

Additional objects, features and advantages will be apparent in the written description, which follows.

DETAILED DESCRIPTION OF THE INVENTION

Figure 1:
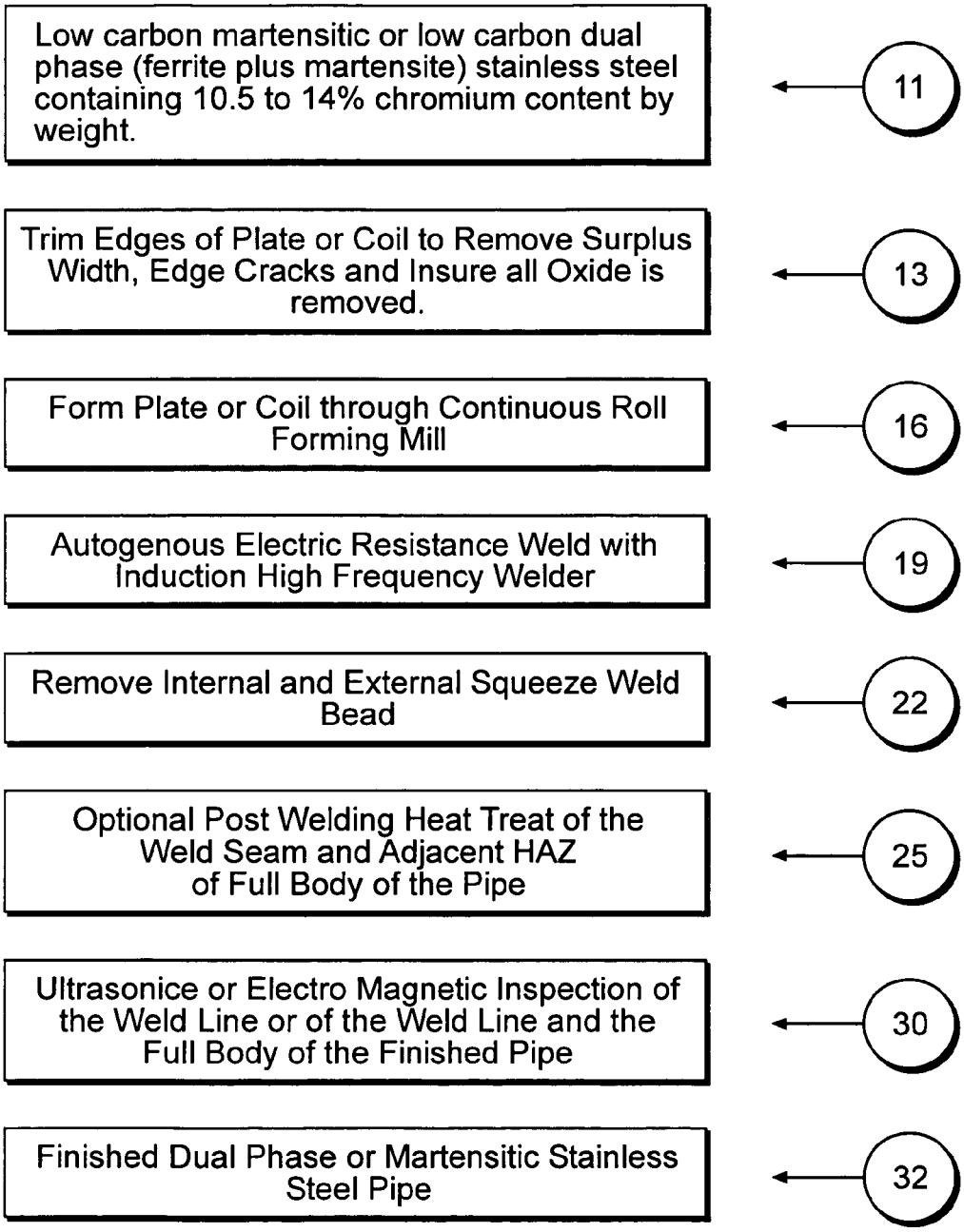
FIG. 1 is a simplified flow diagram illustrating the steps in the method of the invention.

Referring now to FIG. 1 of the drawings there is shown in schematic fashion, a particularly preferred method of practicing the present invention. In the first step of the method, illustrated as 11, a finished plate or coil of corrosion or erosion resistant low carbon (0.080% maximum content by weight) dual phase (ferrite plus martensite) stainless steel with 10.5 to 14% chromium content by weight and/or low carbon (0.080% maximum content by weight) martensitic stainless steel with 10.5 to 14% chromium content by weight is provided as the starting material to be formed into the PIPE of the invention. The nature of the steel chemistry for corrosion and/or erosion resistant alloy selected will depend upon the particular environment encountered including the chemistry, temperature, internal and external pressure as well as the abrasive nature of the product to be transported by the stainless steel PIPE, etc. A computer program is available from John Gandy Corporation of Conroe, Tex., to enable a user to design the optimum pipe string taking into account the anticipated environment of the end application. A grade selection computer program is also available from John Gandy Corporation of Conroe, Tex., to enable a user to select the proper chromium content of the PIPE to resist failure of the PIPE and increase the life of the PIPE in its intended application.

Figure 4:
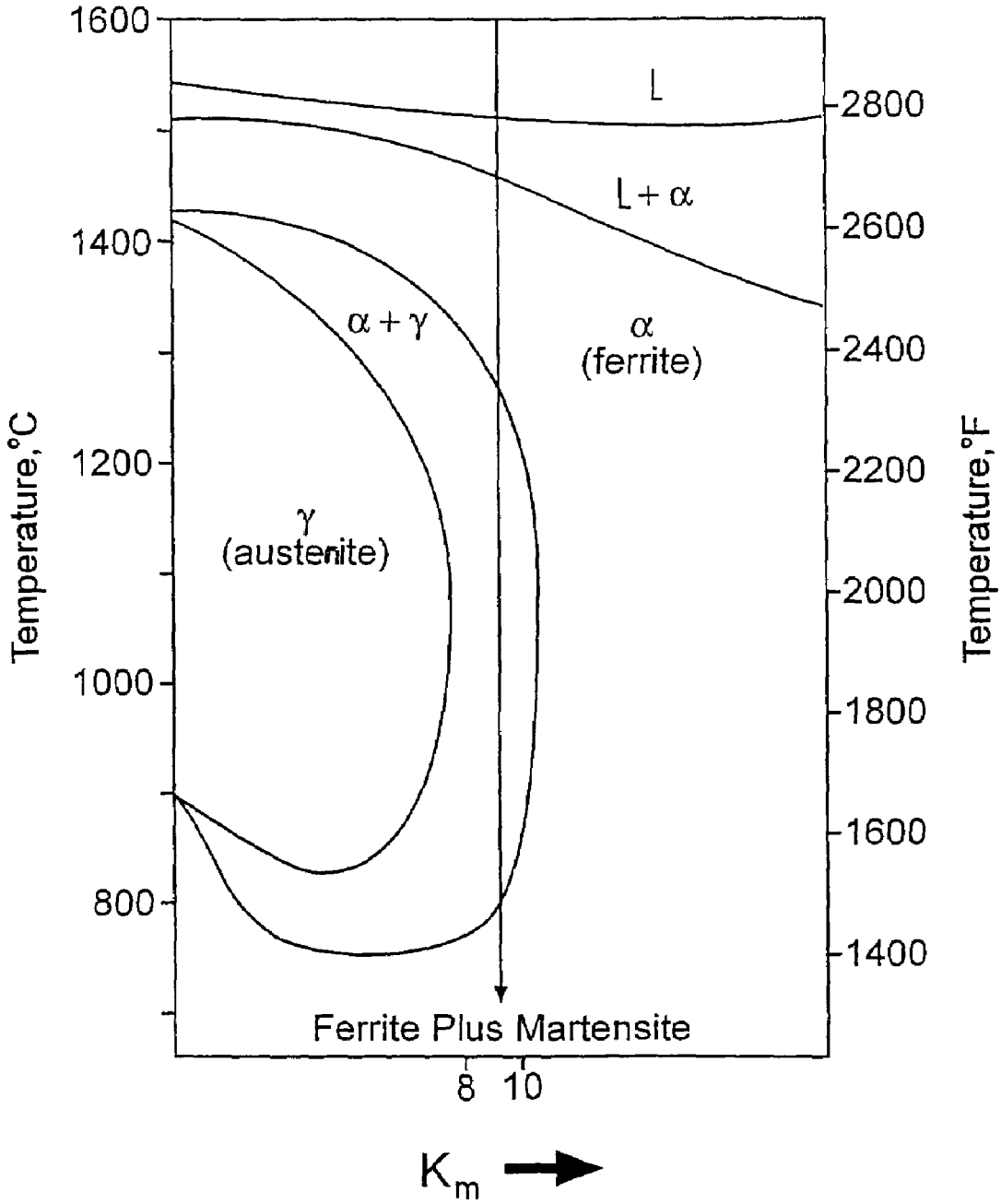
FIG. 4 is a depiction of a stainless steel gamma loop phase diagram with dual phase microstructure chemical balance line exhibited.

Typical examples of corrosion and/or erosion resistant chromium based alloy materials include: (1) 8 to 10 percent chromium; (2) 10 to 14 percent chromium; (3) 12 to 14 percent chromium with 3.5 to 4.5 percent nickel and 8 to 1.5 percent molybdenum; (4) 12 to 14 percent chromium with 4.5 to 5.5 percent nickel and 1.8 to 2.5 percent molybdenum; and (5) 13 to 16 percent chromium with 1.5 percent nickel and 0.5 percent molybdenum. This description of the general classification of corrosion and/or erosion chromium materials actually includes a myriad of material options, depending upon the particular corrosion and/or erosion environment under consideration, and is merely intended to be illustrative to define the invention. FIG. 4 of the drawings depicts the gamma loop phase diagram with dual phase line exhibited for stainless steel. FIG. 4 depicts the formula to derive the Kaltenhauser Factor, which is the chemical balance formula that predict stainless steel microstructures. The Kaltenhauser Factor's formula solution for the microstructure of dual phase stainless steel must be in the range of $K_m$=8 to 10.7 and for the microstructure of martensitic stainless steel must be $K_m$=<7.5; determined by utilizing the formula of: $K_m$=Chromium+6 Silicon+8 Titanium+4 Molybdenum+2 Aluminum−2 Manganese−4 Nickel−40 (Carbon+Nitrogen)−20 Phosphorus−5 Copper. The stated elements are in % by weight. The tempered microstructure will exhibit rows of fine carbides in a ferrite matrix. The following is an example, from the aforementioned formula, and using the following typical steel composition (%):

| C | Mn | P | S | Si | Cu | Ni | Cr | Mo | V | Ti | Al | N |
|---|---|---|---|---|---|---|---|---|---|---|---|---|
| 0.011 | 1.38 | 0.020 | 0.003 | 0.55 | 0.09 | 0.42 | 11.7 | 0.23 | 0.023 | 0.001 | 0.006 | 0.0127 |

When the formula is applied to the above typical steel composition, the resulting Kaltenhauser Factor is 9.702, which falls within the range (8 to 10.7) of dual phase.

Example $$K_m = Cr+6Si+8Ti+4Mo+2Al-2Mn-4Ni-40(C+N)-20P-5Cu$$

$$K_m = 11.7+(6)(0.55)+(8)(0.001)+(4)(0.23)+(2)(0.006)-(2)(1.38)-(4)(0.42)-(40)(0.011+0.0127)-(20)(0.020)-(5)(0.09)$$

$$K_m = 11.7+3.3+0.008+0.92+0.012-2.76-1.68-0.948-0.40-0.45=9.702$$

The preferred method of the invention will now be described with respect to the flow chart shown in FIG. 1. In the preferred embodiment of the invention to be described, the finished low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel plate was obtained from Bethlehem Lukens Plate Company of Coatesville, Pa. The finished plate was manufactured by electric furnace melting and VOD furnace ladle refining followed by continuous casting producing a 9-inch thick slab. The slab was then heated in a slab reheat furnace followed by hot rolling the hot slab into a coil with a 0.375 strip thickness. The rolled coil was then given a temper heat treatment in a car bottom furnace. The tempered coil was then cut-to-length to make plates. The plates were then inspected and tested. If needed there are options to either pickle or shot blast the plates.

Figure 2:
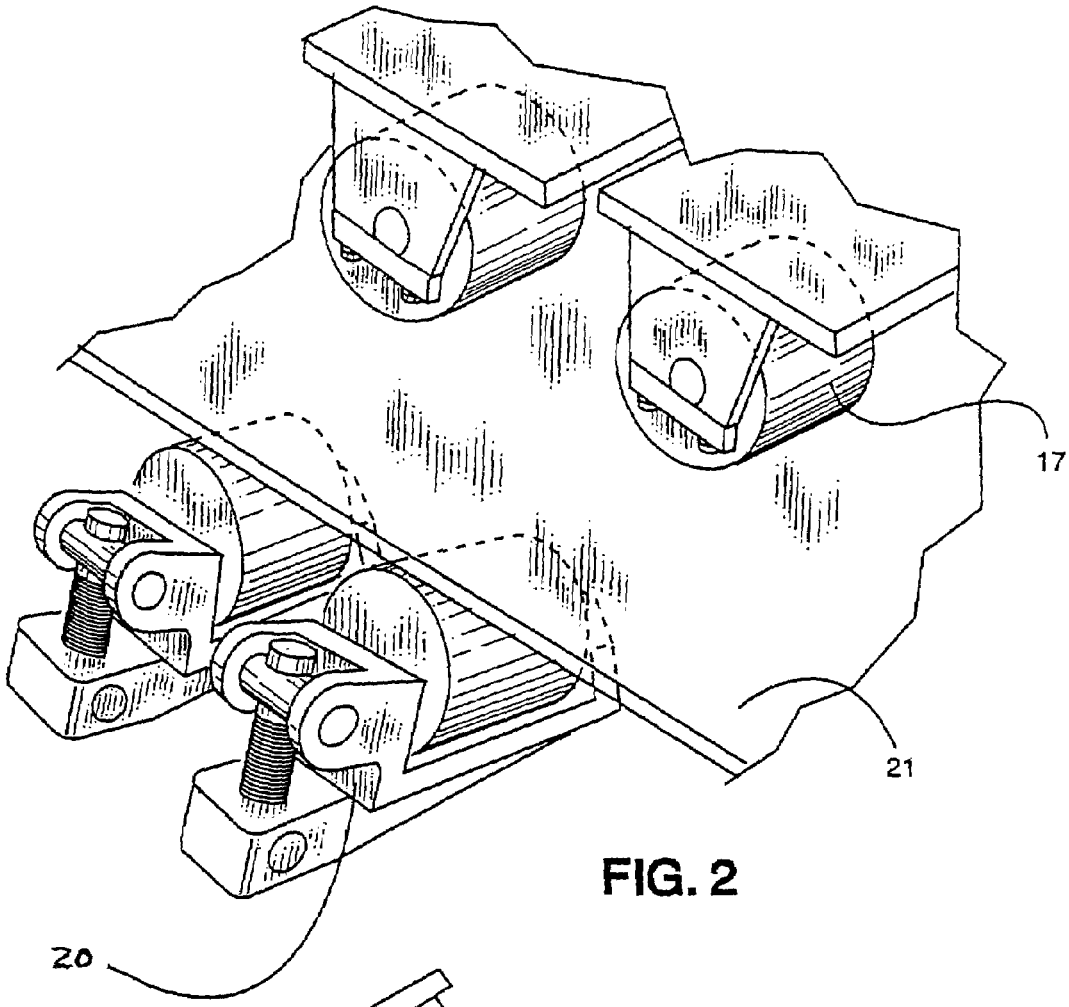
FIG. 2 is a partial, perspective view of a section of finished stainless steel plate being fed through the high speed roll forming mill used in one step of the method of the invention.
Figure 3:
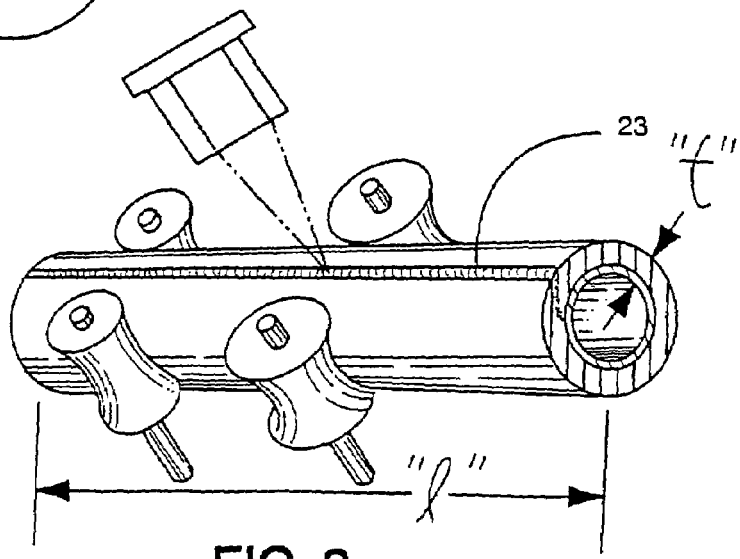
FIG. 3 is a simplified view of a section of the stainless steel PIPE being welded using the welding process of the invention.

The edge-finished plate from step 11 is edge trimmed in step 13 to obtain a specified plate width and removal of edge cracking and oxide that may prevent complete welding of the plate's edges to each other. After step 13, the plate is then passed through a high speed-roll-forming mill in step 16. A significant gain in throughput is achieved in this step by utilizing a high speed roll forming mill to form the chromium stainless steel PIPE in lieu of a slower traditional U-O-E forming mill or break press utilized to form the stainless steel plate into pipe in conjunction with traditional TIG, MIG, Plasma Arc, SAW and DSAW welding. For example, typical production for a standard U-O-E forming mill is (4) to (6) 40 to 50 foot-length plates per hour and the traditional and most utilized is the break press on the order of one 20-foot plate per hour. An ERW high-speed roll form mill is able to achieve a production rate up to 100 feet per minute, with the actual speed dependent upon wall thickness. FIG. 2 of the drawings illustrates a typical commercial high-speed roll-forming mill with longitudinal roller sets 17 and 20 acting upon the steel plate 21. As shown in simplified fashion in FIG. 3, the PIPE produced in step 16 of FIG. 1 has a wall thickness "t", a length "l" and a longitudinal seam region 23, which is formed by feeding the ERW low carbon dual phase (ferrite plus martensite) 10.5 to 14% chromium content by weight stainless steel and/or low carbon martensitic 10.5 to 14% chromium content by weight stainless steel plate or coil through the high speed roll forming mill.

The outer diameter of the resulting PIPE produced by the method of the invention is not critical, but will typically be greater than about 2–6 inches and may be on the order of 12–36 inches or even greater. The practice of the present invention can be especially advantageous as the PIPE diameter increases.

In the next step of the method, the PIPE produced in step 16 is welded along the seam region in Step 19 of FIG. 1 by an Electric Resistance Welding (ERW) process. In general terms, ERW is used in the industry to describe several electric resistance welding processes that are available for tube and pipe production. Each process has different characteristics. Applying a combination of heat and pressure, or forging force, to the plate or coil edges creates a bond of the edges and resultant HAZ due to edge heating before the bonding process. A successful bond uses the optimum amount of heat, which is normally slightly less than the melting point of the stainless steel, and a nearly simultaneous application of circumferential pressure to the section of the tube, which forces the heated edges together. The heat generated by the weld power is a result of the steel's resistance to the flow of electrical current. The pressure comes from rolls that squeeze the tube into its finished shape. The two main types of ERW are high frequency and rotary contact wheel techniques. In the preferred method of the invention, the technique of high frequency, induction welding is employed. In the case of high-frequency induction welding, the weld current is transmitted through a work coil in front of the weld point. The work coil does not contact the tube and electrical current is induced into the material through magnetic fields that surround the tube. High-frequency induction welding eliminates contact marks and reduces the setup required when changing tube size. It also requires less maintenance than contact welding.

In the preferred embodiment of the invention described herein, the ERW welding process was performed on low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel PIPE manufactured by Lone Star Steel Company a leading manufacturer of welded steel PIPE at their Bellville Tube Division in Bellville, Tex. In addition Tubacero, S.A. de C.V. a leading large outside diameter welded steel line PIPE manufacturer in Monterrey, N. L., Mexico welded 24 inch outside diameter low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel PIPE to be utilized for transportation of a liquid slurry in tar sands mining. To Applicant's knowledge, induction welding by the ERW process has not been used to join the seam region 23 in FIG. 3 of stainless steel PIPE of low carbon (0.080% maximum content by weight) dual phase (ferrite plus martensite) with 10.5 to 14% chromium content by weight or low carbon (0.080% maximum content by weight) martensite with 10.5 to 14% chromium content by weight prior to Applicant's introduction of individual test products of small OD, light wall PIPE welded by Lone Star Steel and large OD, heavy wall PIPE welded by Tubacero S.A. de C.V. for tests of the ERW process. While such techniques have been found satisfactory for steel with higher carbon contents by weight and lower chromium and nickel contents, when welding alloys with 10.5 to 14% chromium stainless steel special line conditions such as edge heating time and hot upset pressure are needed to assure refractory type chromium oxides are not left in the bond line to weaken the weld. Chromium oxides are much harder to remove in the hot upset process than iron oxides that are associated with carbon and alloy steels.

Six different alternative welding processes were found to be economically unsatisfactory in large volume for the purpose of practicing the present invention. The traditional welding processes have proven to be uneconomical because of the cost of filler metal, the extremely slow U-O-E and brake press forming and primarily the slow speed welding process. Unlike Applicant's preferred method that does not use filler metal, the other traditional welding processes that utilize a filler metal have been found to be less than satisfactory in terms of weld ductilities. It should be noted, however, that when pipe manufactured according to Applicant's improved process is repaired, as when minor flaws are discovered during the manufacturing inspection step, that a filler metal may be used to make the repair.

In the particularly preferred method of the invention, the plate edges are prepared to meet the necessary criteria to induction weld the longitudinal edges full length of the formed low carbon (0.080% maximum content by weight) dual phase (ferrite plus martensite) stainless steel with 10.5 to 14% chromium content by weight and/or low carbon (0.080% maximum content by weight) martensitic stainless steel with 10.5 to 14% chromium content by weight PIPE. The formed plate's edges are compressed so that the hot upset process result is squeezed out on the inside and outside diameter of the welded pipe during the ERW process. The ERW process in Step 19 of FIG. 1 is then performed as calculated to heat the low carbon (0.080% maximum content by weight) dual phase (ferrite plus martensite) with 10.5 to 14% chromium content by weight and/or low carbon (0.080% maximum content by weight) martensitic with 10.5 to 14% chromium content by weight stainless steel to the correct temperature that results in producing the proper amount of squeeze with the calculations based on the electric current frequency of the induction welder, wall thickness and the longitudinal travel speed of the pipe through the welder. The excess squeeze in Step 22 of FIG. 1 is then immediately removed by an inside and an outside scarfing tool following the ERW in Step 19 of FIG. 1 while the metal squeeze out remains pliable from the welding temperature.

The next step, illustrated as 25 in FIG. 1, is an optional heat treat of the weld and the adjacent HAZ or full body heat treat to make the HAZ ductile, that is, of like physical characteristics of the non-welded portion of the low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel PIPE. In some cases the type of heat treatment process is dependent on the anticipated corrosion and/or erosion conditions in conjunction with strength requirements that are expected in the PIPE's intended use.

Following the above described procedures, and in all circumstances, the weld seam or the full body of the low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel PIPE'S weld line and/or PIPE'S full body is ultrasonically or electro-magnetically inspected in a Step 30.

In Step 32 of FIG. 1, the low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel PIPE is finished.

An invention has been provided with several advantages. The process is an economical alternative for chromium stainless steel PIPE manufactured by the pierced seamless billet, and/or the Laser, TIG, MIG, Plasma, SAW and the DSAW welded methods. Additionally, the process offers a PIPE with a very narrow weld HAZ with higher ductility than PIPE manufactured by other welded methods using filler metal. The continuous high-speed rolling mill located in-line with the ERW welder utilized in one step in the process provides distinctive though-put advantages over the slower traditional U-O-E and break press methods. U-O-E and break-press are traditionally used in the manufacturing process for the forming of the PIPE to be TIG, MIG, Plasma, SAW or DSAW welded. Unrestricted PIPE lengths may be attained in the ERW and Laser processes through utilization of coil forms of low carbon (0.080% maximum content by weight) dual phase (ferrite plus martensite) 10.5 to 14% chromium content by weight stainless steel and/or low carbon (0.080% maximum content by weight) martensitic 10.5 to 14% chromium content by weight stainless steel that are not restricted in a continuous roll forming mill. PIPE from seamless billets and seamless pipe producing mills are traditionally restricted to lengths less than 50 foot. Traditional U-O-E mills form 50 foot or shorter lengths and a traditional break press forms up to 20-foot lengths.

While the invention has been shown in one of its forms, it is not thus limited and is susceptible to various changes and modifications without departing from the spirit thereof.

I claim:

1. A method of manufacturing a heavy walled welded pipe formed of corrosion/erosion resistant stainless steel, the method comprising the steps of:

providing as a starting material a selected one of a finished plate or coil, the selected plate or coil being formed of a corrosion/erosion resistant metal which is itself selected from the group consisting of stainless steels of the chromium, molybdenum and carbon families and mixtures thereof;

passing the starting material through a continuous high speed forming mill to produce a formed body having a longitudinal seam region and a wall thickness;

welding the formed body along the longitudinal seam region to achieve an autogenous electric resistance weld with induction high frequency welder to thereby produce a welded pipe;

wherein the starting material is selected from a corrosion/erosion resistant stainless steel characterized as having less than about 0.080% maximum content by weight carbon and from about 10.5 to 14% content by weight chromium;

wherein the corrosion/erosion resistant stainless steel is a low carbon dual phase (ferrite plus martensite) stainless steel; and wherein the corrosion/erosion resistant stainless steel starting material has a specifically defined microstructure as determined by the Kaltenhauser Factor's formula:

$$K_m = \text{Chromium} + 6(\text{Silicon}) + 8(\text{Titanium}) + 4(\text{Molybdenum}) + 2(\text{Aluminum}) - 2(\text{Manganese}) - 4(\text{Nickel}) - 40(\text{Carbon} + \text{Nitrogen}) - 20(\text{Phosphorus}) - 5(\text{Copper});$$

where Km=the Kaltenhauser Factor; and wherein Km is in the range of 8 to 10.7.

2. The method of claim 1, wherein a weld is produced along the longitudinal seam region characterized by complete weld penetration being achieved through the wall thickness of the formed body without the use of filler metal.

3. The method of claim 2, wherein the weld pipe is further characterized as having an oxide free weld bond line along the longitudinal seam region.

4. The method of claim 1, wherein the pipe body has a finished outside diameter greater than about 6 inches.

5. The method of claim 4, wherein the pipe body has a finished outside diameter greater than about 12 inches.

6. The method of claim 1, wherein the welding process results in a soft low carbon martensitic heat affected zone of the pipe, the method further comprising the steps of:

optional post induction or gas fired heating of the heat affected zone in a temper heat treatment step, the temper heat treatment of the soft low carbon martensitic heat affected zone of the pipe providing a resulting improved weld ductility along the longitudinal seam region; and performing a full body inspection and/or a weld zone inspection upon the finished pipe.

7. The method of claim 6, wherein the inspection is performed by means of an ultrasonic inspection and/or an electromagnetic inspection process to insure that the pipe body and heat affected zone are free of specification defects.

8. The method of claim 1, wherein the resulting pipe has a given maximum outer diameter, the maximum outer diameter being limited only by the maximum size of the continuous roll forming mill.

* * * * *